US009292004B2

(12) United States Patent
Raggi et al.

(10) Patent No.: US 9,292,004 B2
(45) Date of Patent: Mar. 22, 2016

(54) GONG FOR STRIKING-WORK DEVICE OF A TIMEPIECE

(71) Applicant: Société anonyme de la Manufacture d'horlogerie Audemars Piguet & Cie, Le Brassus (CH)

(72) Inventors: Lucas Raggi, St-Blaise (CH); Jean-Daniel Lüthi, Russy (CH)

(73) Assignee: Société anonyme de la Manufacture d'horlogerie Audemars Piguet & Cie, Le Brassus (CH)

( * ) Notice: Subject to any disclaimer, the term of this patent is extended or adjusted under 35 U.S.C. 154(b) by 175 days.

(21) Appl. No.: 14/052,162

(22) Filed: Oct. 11, 2013

(65) Prior Publication Data

US 2014/0104994 A1 Apr. 17, 2014

(51) Int. Cl.

| | |
|---|---|
| ***G04B 21/08*** | (2006.01) |
| ***G04B 23/02*** | (2006.01) |
| ***G04B 21/00*** | (2006.01) |
| ***G10K 1/10*** | (2006.01) |

(52) U.S. Cl.

CPC ..... *G04B 21/00* (2013.01); *G04B 21/08* (2013.01); *G04B 23/028* (2013.01); *G10K 1/10* (2013.01)

(58) Field of Classification Search

CPC ..... G04B 21/00; G04B 21/08; G04B 23/028; G10K 1/10

USPC ..... 368/243, 267, 269, 271, 272, 273

See application file for complete search history.

(56) References Cited

U.S. PATENT DOCUMENTS

| | | | | |
|---|---|---|---|---|
| 2,948,105 | A * | 8/1960 | Levy | 368/244 |
| 5,578,775 | A * | 11/1996 | Ito | 84/297 S |
| 7,746,732 | B2 | 6/2010 | Chritin et al. | |
| 8,050,149 | B2 | 11/2011 | Karapatis et al. | |
| 2009/0091431 | A1 * | 4/2009 | Chritin et al. | 340/392.2 |
| 2011/0158058 | A1 * | 6/2011 | Marechal et al. | 368/243 |
| 2012/0063275 | A1 * | 3/2012 | Favre et al. | 368/243 |
| 2012/0155227 | A1 | 6/2012 | Karapatis et al. | |

FOREIGN PATENT DOCUMENTS

| | | | |
|---|---|---|---|
| CH | 702 145 | A1 | 5/2011 |
| CH | 703 776 | A2 | 3/2012 |
| CH | 704 593 | A2 | 9/2012 |
| EP | 2 107 437 | A2 | 10/2009 |
| EP | 2 207 069 | A2 | 7/2010 |
| EP | 2 463 731 | A1 | 6/2012 |

OTHER PUBLICATIONS

Machine translation of EP2463731, retrieved from the internet Jun. 14, 2015.*

Machine translation of CH704593, retrieved from the internet Jun. 14, 2015.*

* cited by examiner

*Primary Examiner* — Vit W Miska

(74) *Attorney, Agent, or Firm* — Christensen Fonder P.A.

(57) ABSTRACT

A gong for a striking-work device of a timepiece. The gong includes a spring blade forming a main body of the gong and is adapted to act as a vibrating member so as to produce a sound following an actuation. The spring blade includes at least one opening formed in its main body. The invention also includes a timepiece, such as a mechanical watch, comprising such a gong.

15 Claims, 5 Drawing Sheets

GONG FOR STRIKING-WORK DEVICE OF A TIMEPIECE

RELATED APPLICATION

The present application claims priority to Swiss Patent Application No. CH 02002/12 filed Oct. 15, 2012, the disclosure of which is hereby incorporated by reference herein in its entirety.

FIELD OF THE INVENTION

The present invention relates to a gong for a striking-work device of a timepiece, the gong comprising a spring blade forming a main body of said gong and adapted to serve as a vibrating element in order to produce a sound following an actuation.

BACKGROUND

This type of device has long been known in principle. Striking-work timepieces having been common in times past because they are able to deliver auditory information concerning the current time during the night or in darkness. Since the arrival of radium, fluorescent dials, and other means for illuminating the dial making it possible to read the time adequately even in darkness, thus simplifying the construction, the creation, and the use of watches, the integration of striking-work mechanisms, due to the complication of the corresponding movements as well as the horological skill necessary for their production, has become a subject reserved for top-of-the-range timepieces. The manufacture of striking-work mechanisms, in particular gongs, until recently therefore was hardly developed and was based on a predominantly empirical know-how, which resulted in a variability of the sound of the produced striking-work watches.

In general, a striking-work mechanism of a watch is formed of at least one gong and a hammer, which strikes, following its actuation, against the gong so as to vibrate the gong. The gong often has the form of a circular arc so as to advantageously surround the movement of the watch by being placed in a plane parallel to the dial of the watch. It is normally formed by a wound metal wire, one of its ends being fixed to a blom stud, itself mounted rigidly on a plate of the watch, whereas the other end generally remains free. In some embodiments, the blom stud is connected to the middle so as to promote the sound transmission. The gong therefore acts as a resonator and the blom stud transmits the vibration of the gong to the plate of the watch, thus enabling a radiation of the sound waves, which are audible to the user in the form of a generated sound.

Normally, a striking-work watch comprises two gongs, the hour gong and the minute going, but may also comprise three or four gongs, which is known by the name of a chime, and may even comprise more gongs. The corresponding conventional gongs primarily differ in diameter and in length so that the sound generated is different, for example deep for the hour gong and high for the minute gong.

In order to produce the desired sound, in particular with regard to the tonal pitch thereof, its frequency composition and its difference compared to the sound produced by other gongs present in the watch, the amplitude, the period of the vibrations, and also the length of the gong have to be carefully adjusted. In fact, if the rigidity of the gong is excessive, the gong will not vibrate sufficiently. If, by contrast, the gong is too soft, the sound produced therefore will not be satisfactory.

These problems have only recently been studied in greater detail in the horological industry, and less empirical efforts in nature have been undertaken in order to develop gongs that produce a sound of which the frequency composition is determined beforehand.

In fact, the spectrum of a musical sound is generally composed of a base frequency, the first harmonic, and several harmonics which are integer multiples of the base frequency. The sound produced by an instrument may also comprise frequencies which are not integer multiples of the base frequency and are called partial frequencies. With regard to the horological field and the gongs of striking-work mechanisms, the vibration of the gong or the frequency composition of the sound thus produced normally comprises a number of partial frequencies. In particular, the base frequency perceived during the actuation of a striking-work does not correspond to the first characteristic frequencies of the gong itself. Hereinafter, the term base frequency means the tonal pitch perceived. This thus results from a combination of the spectral components contained in the vibratory behavior of the gong and the elements associated therewith in the chain of wave propagation at the origin of the sound.

The presence of partial frequencies in a sound can be perceived by a human as pleasant or unpleasant depending on the number of partial frequencies and their respective positions in the spectrum. The totality of the spectrum formed by the different harmonics and partial frequencies determines the tonal pitch of the sound as perceived by a human. In addition, the human perception of the sound depends not only on the number and position of the partial frequencies, but also on their amplitude. This may create discord or, on the contrary, harmony regarding the human perception of the sound produced. Generally, it is considered that the three first partial frequencies contribute to determining the tonal pitch and that the following partial frequencies determine the timbre of the sound, which is commonly called the richness, beauty or color of the sound.

In particular, the frequency composition of a sound produced by a gong, and therefore the frequency position of the harmonics and partial frequencies, can be influenced by the choice of the material, that is to say the physical properties, and also by the choice of the geometry of the gong. For a given geometry of the gong, the choice of the material allows to modify the position of the base frequency perceived and the color of the sound. The position of a harmonic modifies the vibration of the gong. The damping of one or more vibration modes can be influenced as a result. The frequency distribution of the partial frequencies always follows the same law in this case. The choice of the geometry of the gong for its part allows to modify the ratios between the partial frequencies, for example by modifying the rigidity of the gong.

Based on these facts, the above-mentioned efforts, which have been undertaken in recent years by the horological industry so as to enable the production of gongs generating a sound well determined beforehand, in particular in terms of its tonal pitch and frequency composition, concerned either the choice of material or the choice of geometry of the gong.

For example, document EP 2 107 437 proposes the use of precious materials such as gold or silver for the fabrication of gongs, this due to the physical properties of these materials with regard to the modulus of elasticity relative to their mass density, thus enabling the production of a sound having an increased number of partial frequencies. As mentioned above, the choice of the material does, however, not allow the frequency distribution of the partial frequencies relative to one another and thus remains a parameter having relatively little potential of alone achieving all the desirable characteristics of a gong.

Consequently, further efforts have been directed to the modification of the geometry of the gong, for example as described in document U.S. Pat. No. 7,746,732. Such a gong has a cross section that is variable at least in part along its longitudinal axis, for example continuously or by a succession of increases and decreases in its cross section. Although the quality of the sound can thus be improved, the fabrication of such a gong remains rather complicated and unsuitable for production on an industrial scale.

Another example of an effort targeting a specific gong geometry is disclosed in document CH 702 145. A gong as proposed in this document comprises a middle part having at least two different cross-sectional portions. This gong is based on the same principle as document U.S. Pat. No. 7,746,732, the variation of the cross section of the gong, apparently by simplifying the embodiment of the corresponding gong. However, it is not obvious whether this proposition allows to obtain an improvement in terms of the sound produced simultaneously with a simplification of the production process, also because the different cross-sectional portions are formed by metal wires having different diameters assembled by brazing or soldering. In fact, this should lead either to a rather complex production process in terms of the brazing or soldering method or to a reduction in the quality of the gong obtained.

The prior art solutions currently known therefore either have a rather complex structure preventing acceptable production of the corresponding gongs or do not allow to obtain a gong having all the desirable characteristics with regard to the quality to the sound produced.

SUMMARY

There is thus still a need to provide a gong for a striking-work device of a timepiece of the above-mentioned type of which the structure is relatively simple and which nevertheless allows to generate a sound well determined beforehand, in particular with regard to its tonal pitch and its frequency composition, due to the fact that the amplitude and period of the vibrations of the gong that will be produced following an actuation under predetermined conditions are carefully adjusted during the production of said gong. In addition, it is desirable if such a gong can have not only predefined properties with regard to the tonal pitch and the frequency composition of the sound generated, but if it is also possible to adjust the difference of the sound generated compared to the sound produced by other gongs present in the watch, that is to say to adjust the harmony between different gongs provided in a given striking-work mechanism, or even by taking into account the wishes of an individual user, who is normally the purchaser of the corresponding timepiece. These objectives should be achieved while ensuring reasonable production costs and simple integration into known striking-work mechanisms.

The object of the present invention is therefore to overcome the disadvantages of the known gongs and to provide the above-mentioned advantages, in particular to enable the production of a striking-work which is of simple design and which has an amplitude and a period of vibrations predetermined during its fabrication, thus producing a sound having a tonal pitch, a frequency composition, and a difference compared to other gongs, adjusted beforehand.

To this end, the present invention proposes a gong of the above-mentioned type, in particular for integration into a striking-work device of a mechanical timepiece, said gong being distinguished in an embodiment by the features specified in claim 1, and also a corresponding timepiece comprising such a gong. In particular, the spring blade of a gong according to the present invention comprises at least one opening formed inside its main body. These openings can be through-openings or blind openings. The shape and size of these openings can be adapted according to requirements, as can the plane in which they are arranged. The openings are preferably machined by means of a cutting laser or an ablation laser, by electrical discharge machining, by micromachining, or by water jet, or by any other suitable process.

In an embodiment of the gong according to the present invention, at least one of these openings can be filled at least in part by addition of a material other than the material in which the main body of the spring blade is fabricated. The filling material for example may consist of gold, silver, platinum, or a metal alloy.

The shape of the cross section of the main body of the spring blade of the gong, the shape of the gong itself, and also the material of the main body of the spring blade can be selected according to requirements.

As a result of these measures, the geometry and the material composition of the gong is modified locally, and therefore its rigidity, which allows to influence the vibratory behavior of the gong following an actuation. Due to the fact that a gong according to the present invention can thus be adapted to requirements both by varying the geometry of the gong and, where necessary, by modifying the material forming the gong, it is possible to influence the sound produced by the gong with an increased level of precision.

Further features and the corresponding advantages will be described in greater detail in the dependent claims and also in the description of the invention provided hereinafter.

BRIEF DESCRIPTION OF THE DRAWINGS

The accompanying drawings show schematically and by way of example a number of embodiments of a gong according to the present invention.

DETAILED DESCRIPTION

The invention will now be described in detail with reference to the accompanying drawings illustrating a number of embodiments of the invention by way of example.

Figure 1A:
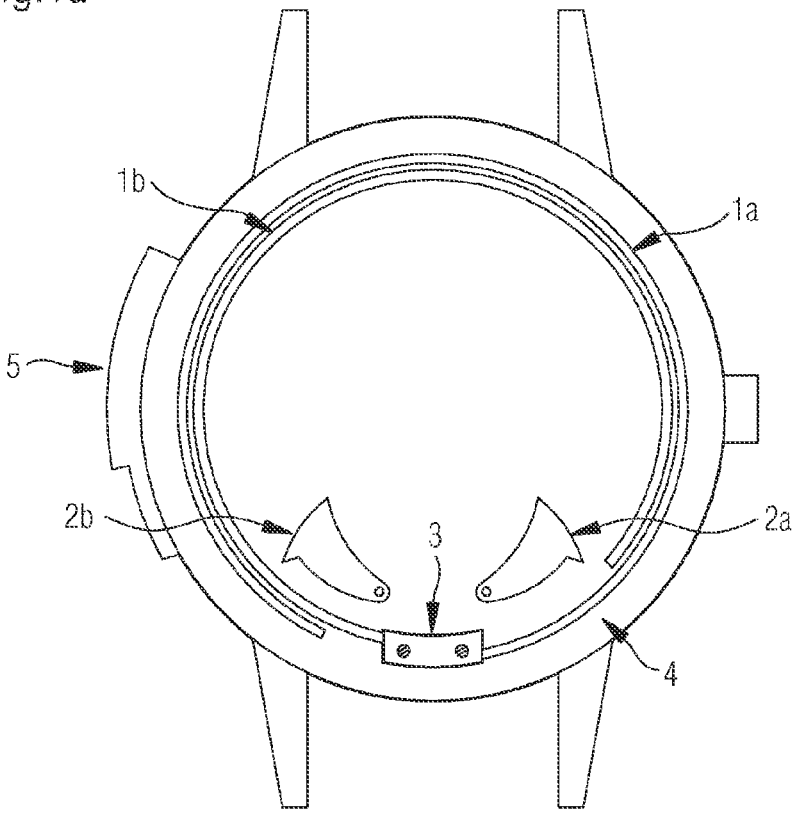
FIG. 1*a* shows a schematic plan view of a traditional structure of a striking-work mechanism comprising gongs and hammers, mounted on the frame of a timepiece.

A striking-work gong according to the present invention is to be integrated into a timepiece, in particular into a mechanical bracelet watch. The schematic plan view in FIG. 1*a* shows the conventional structure of a striking-work mechanism comprising two gongs 1*a*, 1*b* and two corresponding hammers 2*a*, 2*b*, mounted on the frame of a timepiece. Each gong 1*a*, 1*b* is fixed at one of its ends on a blom stud 3 serving as a gong support and itself mounted on a plate 4 of the timepiece, which is illustrated by way of example in FIG. 1*a* as a bracelet watch. The other end of each gong 1*a*, 1*b* is free. Each gong 1*a*, 1*b* is arranged in a plane parallel to the dial of the watch, arranged above the plate 4, and extends along a circular arc around the movement of the watch, which is not illustrated in FIG. 1*a* for reasons of simplification. Each gong 1*a*, 1*b* is preferably formed by a wound metal wire forming said circular arc. Once the striking-work mechanism is wound by means of a push-piece 5, the striking-work is released. To this end, the hammers 2*a*, 2*b* serving, for example, as an hour hammer 2*a* and a minute hammer 2*b* and possibly having different masses are moved alternately by the striking-work mechanism. Said mechanism will not be described here since it does not form the subject of the present invention. During its movement, each hammer 2*a*, 2*b* normally carries out a partial rotation in the plane of the corresponding gong 1*a*, 1*b* and strikes said gong, thus producing a vibration of the gong 1*a*, 1*b*. The propagation of the vibration of the gong 1*a*, 1*b* through the blom stud 3 as far as the plate 4 then produces sound waves, of which some are in the spectrum audible for a human.

Figure 1B:
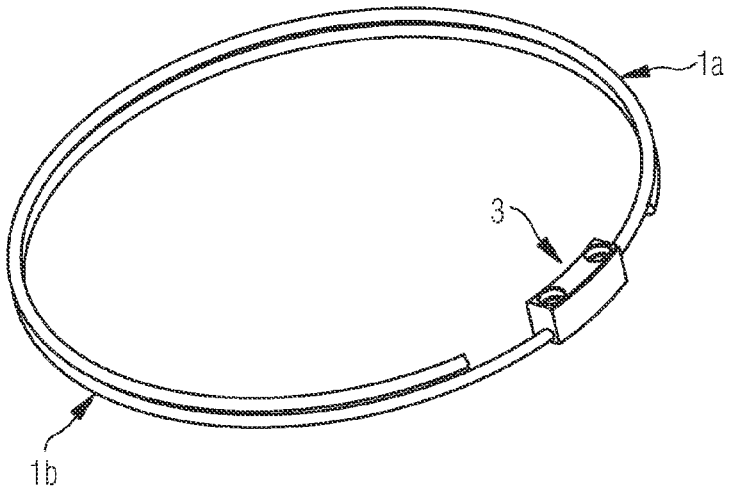
FIG. 1*b* is a perspective view of an embodiment with two superimposed gongs in their state fixed to a blom stud.

FIG. 1*b* is a perspective view of an embodiment with two superimposed gongs, in their state fixed to the blom stud 3. As can be seen from FIG. 1*b*, the gongs 1*a*, 1*b* may, for example, have the same diameter at their circular arc and may be arranged in two superimposed planes at a safety distance ensuring that they do not touch during their vibration. Alternatively, their diameters formed by the corresponding circular arc may be different so as to make it possible to arrange the two gongs in the same plane, as shown in FIG. 1*a*. In general, proceeding from the conventional structure of a striking-work mechanism as illustrated in the figures, and of a corresponding gong, a gong 1 according to the present invention may have any shape, whether a partial circular arc or a straight form along a linear generator or even another specific geometry.

Figure 2A:
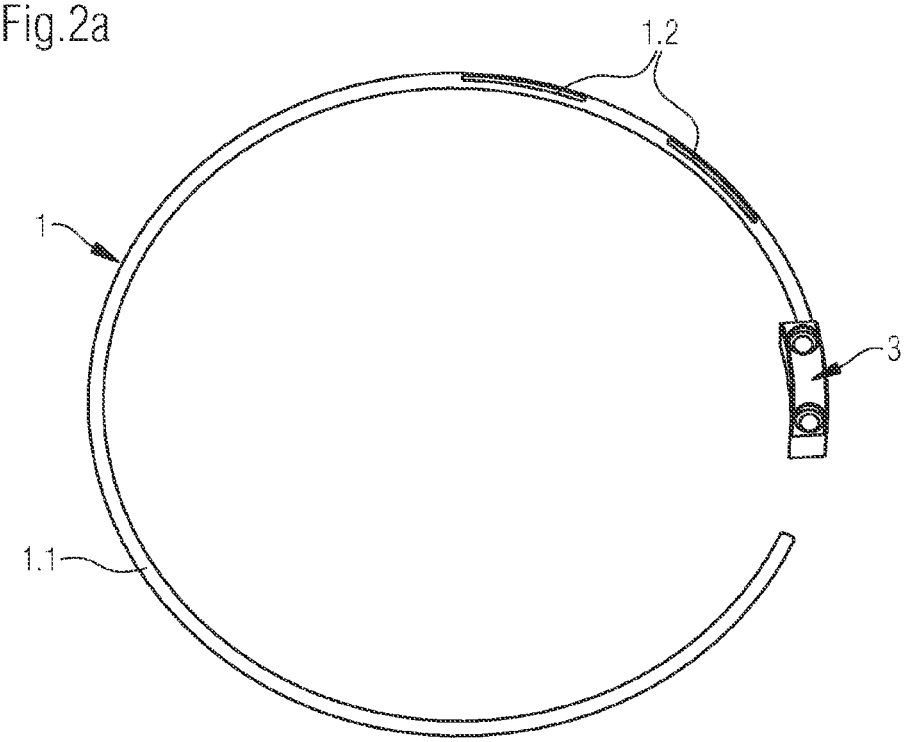
FIGS. 2*a* and 2*b* show schematically and by way of example, by perspective views from above, two embodiments of a gong for a striking-work mechanism according to the present invention, the gong comprising openings inside its main body.
Figure 2B:
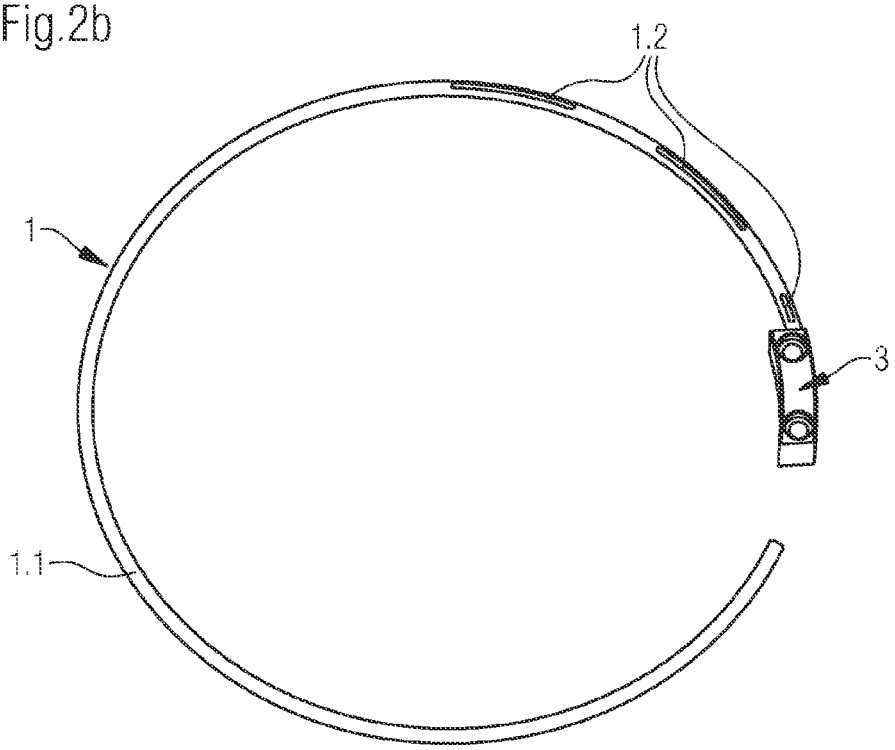

In fact, as is shown schematically and by way of example in FIGS. 2*a* and 2*b*, which, by perspective views from above, show two embodiments of a gong for a striking-work mechanism according to the present invention, a gong 1 according to the present invention comprises a spring blade 1.1 forming a main body of said gong 1 and adapted to serve as a vibrating member in order to produce a sound following an actuation, for example, by means of a hammer 2. In particular, such a gong 1 distinguishes by the fact that the spring blade 1.1 comprises at least one opening 1.2 formed inside its main body.

In a first embodiment illustrated in FIG. 2*a*, the gong 1 has two oblong through-openings 1.2 arranged approximately in the middle and at the end of the first quarter along the circular arc forming the spring blade 1.1 of the gong 1. The two openings 1.2 have approximately the same length along the longitudinal axis of the spring blade 1.1 of the gong 1, although this is not necessary, their respective length being selected depending on requirements. Likewise, the width of these openings 1.2 is identical in the illustrated example, although this is not necessary. This width of the openings 1.2 formed in the main body of the spring blade 1.1 may, in general, be selected in a range between approximately 10% and 85%, preferably between 10% and 40%, of the diameter of the spring blade 1.1, also depending on requirements. In a second embodiment illustrated in FIG. 2*b*, the gong 1 has three oblong through-openings 1.2, of which two correspond substantially to the openings formed in the first embodiment of the gong 1 and of which the third opening, having a much shorter length, is arranged towards the end of the gong 1 assembled on the blom stud 3, this zone subsequent to the setting of the gong 1 in the blom stud 3 being referred to conventionally as the heel of the gong. A gong 1 comprising at least one such opening 1.2 has the advantage that it is possible to modify locally and precisely its geometry so as to determine beforehand the vibratory behavior of the gong 1. In addition, the openings 1.2 increase the radiating surface during the vibrations of the gong 1, which may also be favorable for production of a sound having a tonal pitch and of a gong as desired. The targeted modification of the spring blade 1.1 of the gong 1 by creating openings 1.2 thus allows to influence the amplitude and period of its vibration, thus allowing to determine during a production step, commonly called the tuning of the gong 1, the production of a sound having a tonal pitch, a frequency composition, and a difference compared to any other gongs.

Although, in the two embodiments described above, at least one opening 1.2 in the gong 1 is a through-opening, at least one opening 1.2 in other variants of a gong 1 not illustrated in the figures could be a blind opening. Likewise, it is possible for a blind opening 1.2 to have a variable depth, in particular along the longitudinal axis of the spring blade 1.1. In addition, depending on the number of openings 1.2, said spring blade may comprise one or more through-openings 1.2 and/or one or more blind openings 1.2, without it being necessary to illustrate or describe explicitly all the possible combinations.

As is clear from the above explanations, due to the fact that the length and the width of each opening 1.2 can be selected according to requirements, these openings 1.2 may have a different shape that will generally be selected depending on the specific requirements in view of a given gong. An oblong shape of variable length as illustrated in FIGS. 2*a* and 2*b* is one of the preferred shapes of the openings 1.2 however. The same observation applies to the positioning of each opening 1.2 along the longitudinal axis of the spring blade 1.1 of the gong 1, in the sense that this positioning will be selected as desired according to the requirements for a given gong 1.

Finally, with regard to the orientation of the openings 1.2 formed in the main body formed by the spring blade 1.1 of the gong 1, said openings can be machined in the plane of the movement of the gong 1 during its vibrations, that is to say in the examples illustrated in FIGS. 1*a* and 1*b* in a plane parallel to the plane of the dial or the plate 4. Each opening formed in the gong can also be formed in a plane perpendicular to the plane of movement of the gong 1, as is the case in the embodiments of a gong 1 according to the present invention illustrated in FIGS. 2*a* and 2*b*. These two variants, with regard to the orientation of the openings 1.2, have the advantage of being neutral with respect to the longitudinal axis of the spring blade 1.1 of the gong 1 during its vibrations, provided the width of the opening is arranged symmetrically about said axis and the openings are through-openings. These openings therefore only modify the course of the longitudinal axis of the gong 1 during the vibrations thereof to a minimal extent.

It is nevertheless also conceivable to form these openings 1.2 at an angle other than 0° or 90° with respect to the plane of movement of the gong 1 during the vibrations thereof, for example, at an angle of 30° or 45°, provided this allows to obtain the desired vibratory behavior.

Figure 3A:
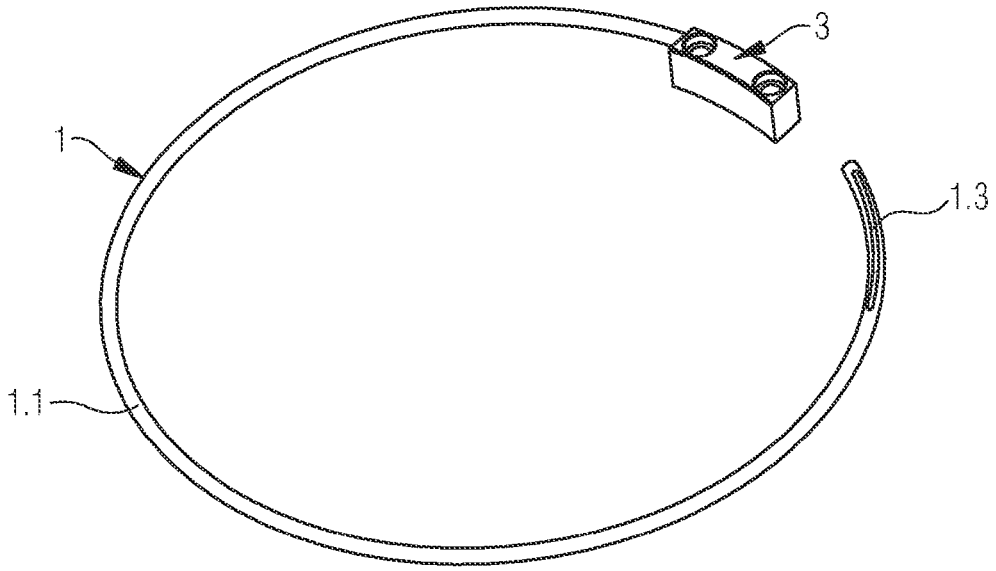
FIGS. 3*a* and 3*b* show schematically and by way of example, by perspective views from above similar to FIGS. 2*a* and 2*b*, two embodiments of a gong for a striking-work mechanism according to the present invention, the gong comprising openings inside its main body, of which at least one is filled with a material other than that of the main body.
Figure 3B:
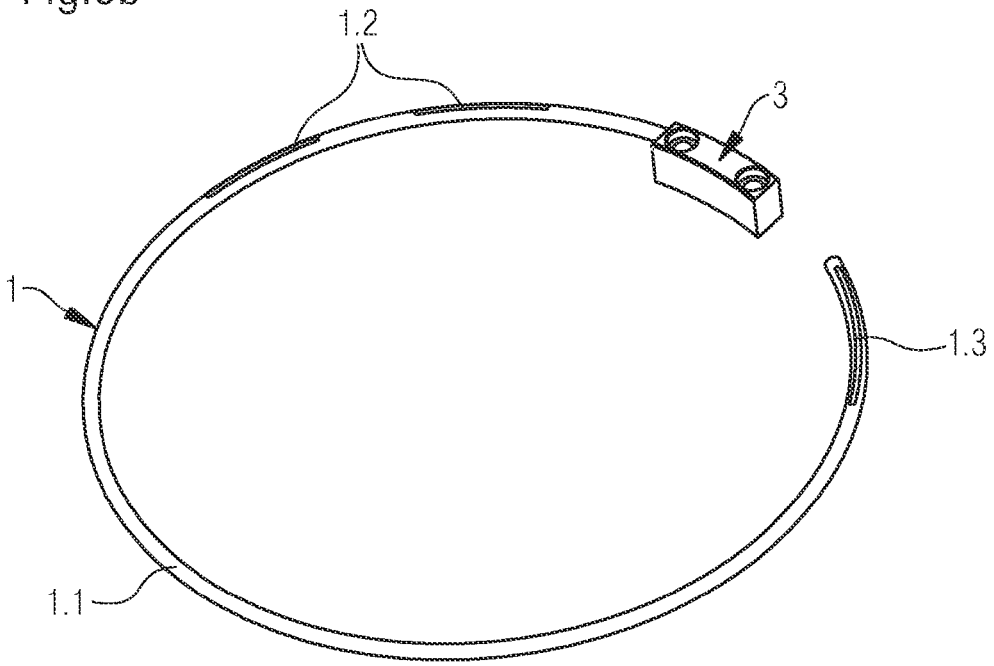

Two other embodiments of a gong for a striking-work mechanism according to the present invention are illustrated schematically and by way of example in FIGS. 3*a* and 3*b* by perspective views from above similar to FIGS. 2*a* and 2*b*. The gong 1 shown in FIG. 3*a* comprises an opening 1.2 in the main body of the spring blade 1.1, said opening being filled with a material 1.3 other than that in which the spring blade 1.1 of the gong 1 is fabricated. The gong 1 shown by way of example in FIG. 3*b* comprises a plurality of openings 1.2, of which one is filled with a material 1.3 other than that in which the spring blade 1.1 of the gong 1 is fabricated. The filling 1.3 of the openings allows to further influence locally and precisely by two other parameters, that is to say by means of the rigidity of the filling material and by its mass density, the rigidity and the weight of the gong 1. The vibratory behavior of a gong 1 according to the present invention can thus be parameterized both with the aid of its geometry and its physical properties, that is to say the material of the main body and the filling material 1.3.

In addition, each opening 1.2 formed in the main body of the spring blade 1.1 of the gong 1 can only be filled partially by addition of a material 1.3 other than that of the main body of the gong 1 instead of being filled completely and homogeneously relative to the outer surface of the gong 1 as illustrated in FIGS. 3*a* and 3*b*. Also, the addition of material 1.3 may protrude slightly beyond the volume of the cavities formed by the openings 1.2. Said other material 1.3 serving to fill the openings is preferably gold, silver, platinum, or a metal alloy of which the Young's modulus and the density can be adapted. The addition of the filling material 1.3 in the openings 1.2 can be implemented, for example, by conventional assembly or by material growth or any other equivalent material deposition method. Generally, it should also be noted in this context that numerous combinations with regard to the positioning and also the nature of the filling material are possible, without the need to illustrate or describe these combinations explicitly here.

Figure 4A:
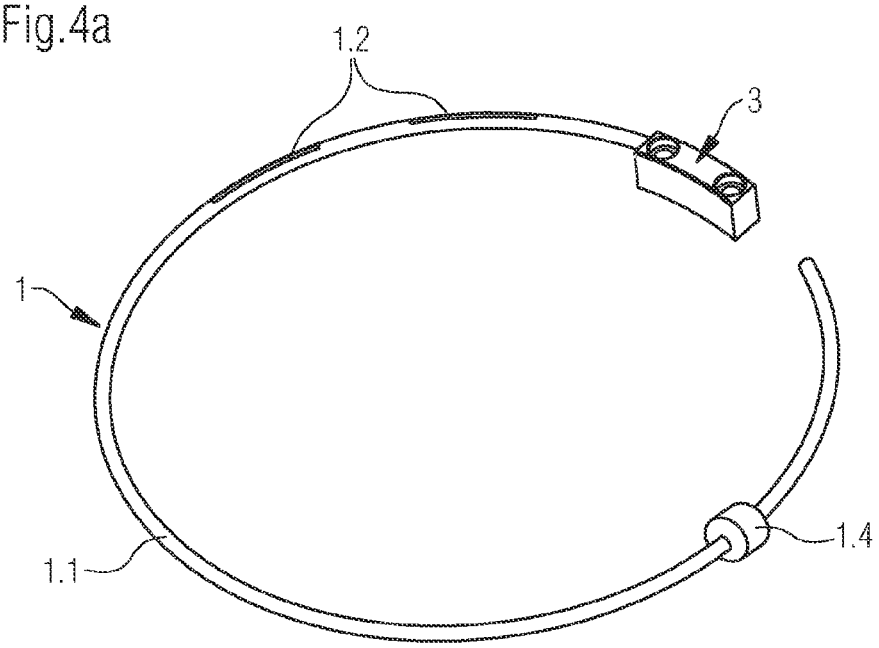
FIGS. 4*a* to 4*c* schematically and by way of example illustrate, by perspective views from above, a number of embodiments of a gong for a striking-work mechanism according to the present invention, the gong comprising openings inside its main body as well as at least one inertia-block mounted on the spring blade of the gong, and in some embodiments at least one opening being filled with a material other than that of the main body.
Figure 4B:
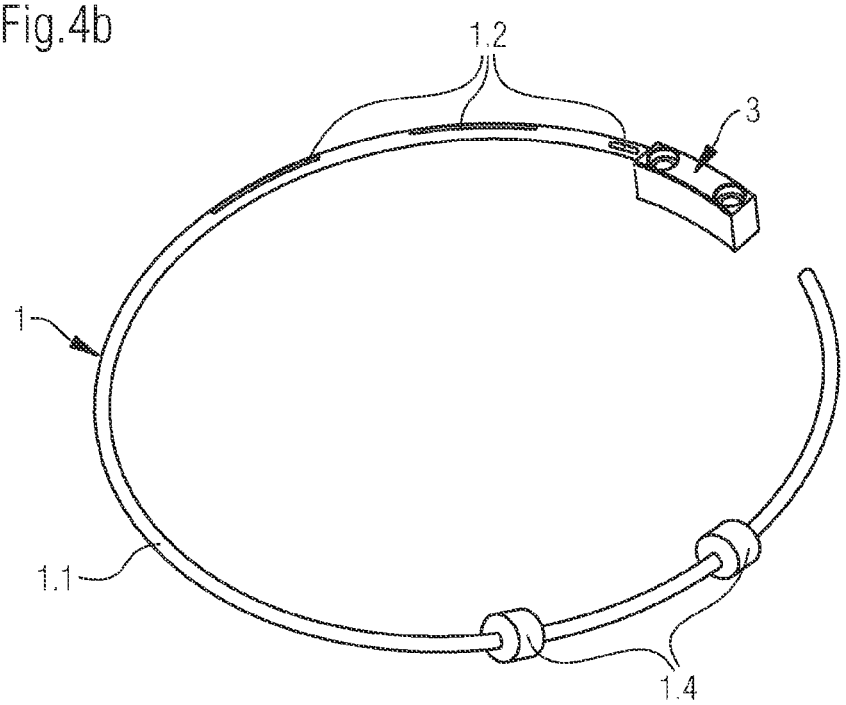
Figure 4C:
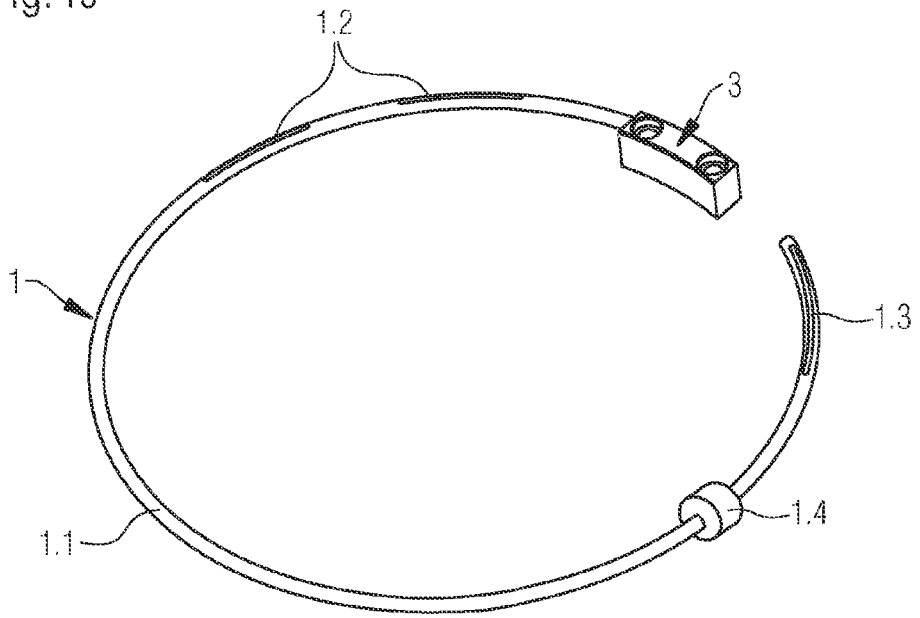

A number of further embodiments of a gong for a striking-work mechanism according to the present invention are also illustrated, schematically and also be way of example, in FIGS. 4*a* to 4*c*, likewise by perspective views from above similar to FIGS. 2*a* and 2*b* and 3*a* and 3*b*. The gong 1 of the embodiment according to FIG. 4*a* comprises openings 1.2 in the main body of the spring blade 1.1 of the gong 1 and also an inertia-block 1.4 mounted on the spring blade 1.1 of the gong 1. The gong 1 of the embodiment according to FIG. 4*b* comprises openings and also two inertia-blocks 1.4 having different masses mounted on the gong 1. The gong 1 of the embodiment according to FIG. 4*c* comprises a plurality of openings 1.2, of which one opening is filled with a material 1.3 other than that of the main body, and also an inertia-block 1.4 mounted on the spring blade 1.1 of the gong 1. Again, the positioning and the size of the inertia-blocks 1.4 are selected according to requirements. A person skilled in the art will understand that, in general, a gong 1 according to the present invention comprises at least one opening 1.2 formed in the main body of the spring blade 1.1 of the gong 1, which may be filled with a material 1.3 other than that of the main body, and may also comprise at least one inertia-block 1.4 mounted on the spring blade 1.1 of the gong 1.

Figure 5:
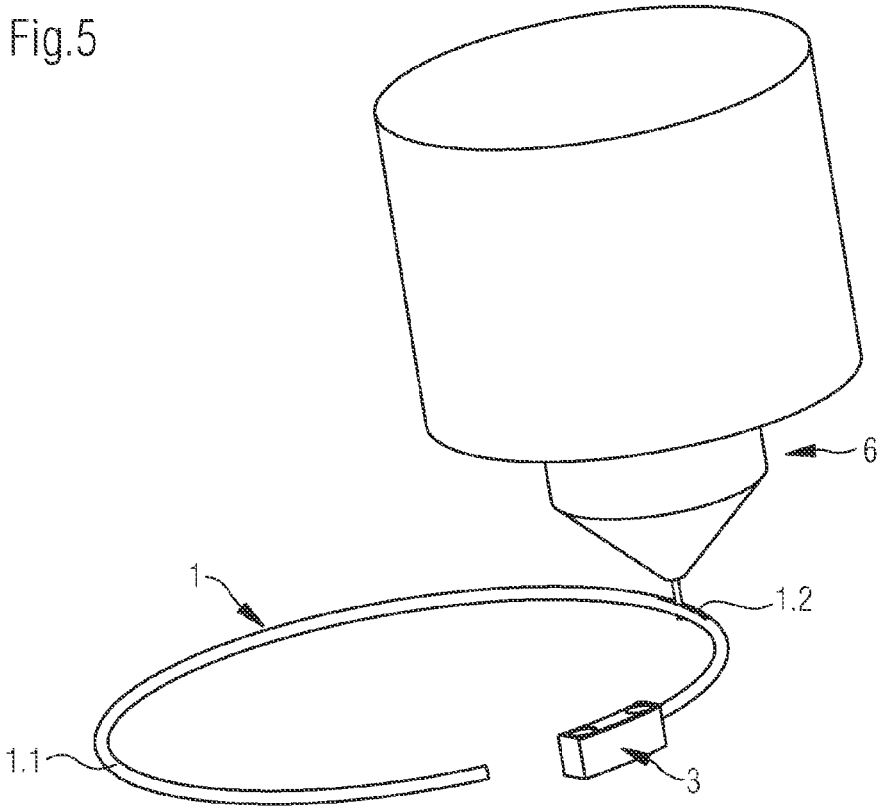
FIG. 5, by way of a basic diagram, shows a step during the production of a gong for a striking-work mechanism according to the claimed invention by means of a cutting laser.

The openings 1.2 are preferably machined from the outer surface of said spring blade 1.1 of the gong 1 by means of a cutting laser 6, as is illustrated schematically in FIG. 5. The openings 1.2 may also be formed however by electrical discharge machining, by micromachining or by water jets, or by any other equivalent material-removing process. It is also conceivable to use an ablation laser or any other suitable method in order to produce a specific structuring of the material located on the surface of the spring blade 1.1 of the gong 1. In general, the openings 1.2 are machined from the outer surface of the spring blade 1.1 of the gong 1 by creating a cavity of which the depth is oriented substantially perpendicular to the longitudinal axis of the spring blade 1.1 of the gong 1 and which extends along said longitudinal axis.

With regard to the spring blade 1.1 of the gong 1, its cross section may be substantially circular, oval, rectangular, or polygonal. Normally, for reasons of simplicity of fabrication, a wire will be selected as the spring blade 1.1 of the gong 1. The diameter of this wire is usually in the range from 0.2 mm to 1.2 mm, preferably in the range from 0.4 mm to 0.8 mm. Also, as mentioned above, in a conventional structure of a horological striking-work mechanism, the gong 1 will traditionally have at least partially the form of a circular arc and consists of a wound wire. The spring blade 1.1 of the gong 1 may only form an incomplete circle, but may also form an arc of more than 360°. As also mentioned above, it is also possible for the spring blade 1.1 of the gong 1 to be straight or to have another specific geometry, the proposed openings 1.2 formed in said spring blade in fact being machineable from the outer surface of the spring blade 1.1 independently of the geometry thereof. The same observation is true for the material of the main body of the spring blade 1.1 of the gong 1. It is nevertheless preferably fabricated from a metal material, for example, tempered steel.

Lastly, it remains to be noted that the present invention relates to any timepiece that comprises a gong 1 according to the present invention. In particular, it may be a mechanical timepiece, in particular a bracelet watch, which is equipped with a striking-work, an alarm, an alert, and/or a repeater mechanism or any other mechanism requiring a gong.

In view of the detailed description of the structure of a gong according to the present invention presented above, it is clear to a person skilled in the art that, besides being a relatively simple and uncomplicated structure compared to the prior art, a gong according to the present invention can be provided in a number of variants and enables versatile use. It is clear that a gong for a striking-work mechanism having the features mentioned above has the significant advantage that the geometry and the material composition of such a gong can be modified locally and precisely, thus influencing its rigidity, which makes it possible to determine, when tuning the gong, the vibratory behavior thereof following an actuation so as to achieve the best ratio between the time of vibration and the sound volume, that is to say the richness and the beauty of the sound based on human perception. Due to the fact that a gong according to the present invention can be adapted to requirements both by varying the geometry of the gong and, where necessary, by modifying the material forming the gong, it is possible to influence with an increased level of precision the sound produced by the gong, in particular the tonal pitch, the frequency composition, and also the period of the sound generated. Such a gong can cooperate in a conventional manner with the other parts of the timepiece in which it is to be integrated, in particular with the striking-work mechanism and the rest of the movement, such that the mechanism can be easily integrated into existing timepieces without the need for specific adjustments. In particular, a gong according to the present invention is of the same size as a corresponding conventional gong, not prompting any change to its outer dimensions provided the addition of material does not exceed the volume of the cavities formed by the openings and provided that no inertia-block is used, whether at the diameter of its cross section or the diameter of the circular arc of the gong, in the case of a traditional structure of striking-work mechanisms. This advantage is very interesting because any increase in the physical size of the gong would consequently, due to its movement during its vibration, cause an even more significant increase in the volume occupied in the watch case. In addition, due to the relatively simple structure of the gong, these advantages are obtained by decreasing the occupied volume compared to similar gongs of the prior art, and by having available methods for fabricating the gong able to offer both the desired quality in terms of the sound produced by the gong and also genuine industrial feasibility of the production process. It should also be noted that a further advantage of a gong according to the present invention consists in the fact that it can be applied to all types of timepieces having a striking-work, repeater watches, alarms, alerts, pendulums, clocks, etc. Likewise, the invention is not limited to gongs adapted to be actuated by striking, in particular by the striking of a hammer, but can also be used for spring blades actuated by friction, for example for spring blades used in mechanical music boxes.

The invention claimed is:

1. A gong for a striking-work device of a timepiece, the gong comprising a spring blade forming a main body of said gong and being adapted to act as a vibrating member so as to produce a sound following an actuation, the spring blade of the gong consisting of a wound wire having at least partially the shape of a circular arc and comprising at least one opening formed in its main body, wherein said at least one opening formed in the main body of the spring blade of the gong is either non-filled or filled at least partially by addition of a material other than that of the main body of the spring blade, said other material used for the filling of said at least on opening being selected from the group of materials consisting of gold, silver, platinum, and a non-ferromagnetic metal alloy.

2. The gong according to claim 1, wherein at least one opening formed in the main body of the spring blade of the gong is a through-opening.

3. The gong according to claim 1, wherein at least one opening formed in the body of the spring blade of the gong is a blind opening.

4. The gong according to claim 1, wherein at least one opening formed in the body of the spring blade of the gong has an oblong shape of variable length.

5. The gong according to claim 1, wherein at least one opening formed in the body of the spring blade of the gong is formed in a plane of movement of the spring blade.

6. The gong according to claim 1, wherein at least one opening formed in the body of the spring blade of the gong is formed in a plane perpendicular to a plane of movement of the spring blade.

7. The gong according to claim 1, wherein at least one opening formed in the body of the spring blade of the gong is machined by means of a cutting or ablation laser, by electrical discharge machining, by micromachining, or by water jet.

8. The gong according to claim 1, wherein at least one inertia-block is mounted on the spring blade of the gong.

9. The gong according to claim 1, wherein the cross section of the main body of the spring blade of the gong is substantially circular, oval, rectangular, or polygonal.

10. The gong according to claim 9, wherein a diameter of the cross section of the main body of the spring blade of the gong lies in the range of 0.2 mm to 1.2 mm.

11. The gong according to claim 1, wherein the main body of the spring blade of the gong is fabricated of a metal material.

12. A timepiece comprising a gong according to claim 1.

13. The timepiece of claim 12, wherein it is a mechanical timepiece, in particular a bracelet watch, equipped with a striking-work, an alarm, an alert, or a repeater mechanism.

14. The gong according to claim 10, wherein the diameter of the cross section of the main body of the spring blade of the gong lies in the range of 0.4 mm to 0.8 mm.

15. The gong according to claim 11, wherein the metal material comprises steel.

* * * * *